US011523654B2

(12) United States Patent
Davis et al.

(10) Patent No.: US 11,523,654 B2
(45) Date of Patent: Dec. 13, 2022

(54) FOOTWEAR ARTICLE WITH HINGED HEEL

(71) Applicant: NIKE, Inc., Beaverton, OR (US)

(72) Inventors: Ami M. Davis, Hillsboro, OR (US); Richard S. Ramsay, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/194,513

(22) Filed: Mar. 8, 2021

(65) Prior Publication Data

US 2021/0282495 A1 Sep. 16, 2021

Related U.S. Application Data

(60) Provisional application No. 62/989,185, filed on Mar. 13, 2020.

(51) Int. Cl.
*A43B 3/00* (2022.01)
*A43B 11/00* (2006.01)
(Continued)

(52) U.S. Cl.
CPC ..... *A43B 3/0036* (2013.01); *A43B 3/24* (2013.01); *A43B 3/242* (2013.01); *A43B 11/00* (2013.01);
(Continued)

(58) Field of Classification Search
CPC ..... A43B 3/242; A43B 3/06; A43B 11/00
See application file for complete search history.

(56) References Cited

U.S. PATENT DOCUMENTS

2018/0110287 A1* 4/2018 Hopkins ..... A43B 23/0295
2019/0082791 A1* 3/2019 Sullivan ..... A43B 11/00
(Continued)

FOREIGN PATENT DOCUMENTS

| | | | |
|---|---|---|---|
| CN | 207544444 | U | 6/2018 |
| IT | PN20100041 | A1 | 1/2012 |
| WO | 2010/048203 | A1 | 4/2010 |

OTHER PUBLICATIONS

International Search Report and Written Opinion received for PCT Patent Application No. PCT/US2021/021815, dated Jun. 2, 2021, 16 pages.

(Continued)

*Primary Examiner* — Ted Kavanaugh
(74) *Attorney, Agent, or Firm* — Shook Hardy & Bacon, LLP

(57) ABSTRACT

A footwear article includes a hinged portion in a heel region that may be biased in various positions to increase or decrease a size of a foot-insertion opening. The hinged portion may be arranged in a first position, in which the hinged portion is more upright and is in position to cup a wearer's heel or Achilles region when the footwear article is worn. In addition, the hinged portion may be hingedly rotated downward or rearwardly (e.g., away from the foot-insertion opening) to a second position, which may increase a size of the foot-insertion opening and/or may change an angle along which a foot can pass through the foot-insertion opening when the footwear article is being donned or doffed. One or more elastic members may be attached to the hinged portion and to some other portion of the footwear article to bias the hinged portion.

12 Claims, 7 Drawing Sheets

(51) Int. Cl.

| | |
|---|---|
| ***A43B 21/433*** | (2006.01) |
| ***A43B 3/24*** | (2006.01) |
| ***A43C 11/12*** | (2006.01) |
| *A43B 3/06* | (2006.01) |

(52) U.S. Cl.
CPC ..... *A43B 21/433* (2013.01); *A43C 11/12* (2013.01); *A43B 3/06* (2013.01)

(56) References Cited

U.S. PATENT DOCUMENTS

| | | | | |
|---|---|---|---|---|
| 2020/0077737 | A1 | 3/2020 | Hatfield et al. | |
| 2020/0345098 | A1* | 11/2020 | Xanthos ..... | A43B 11/00 |
| 2022/0132979 | A1* | 5/2022 | Hatfield ..... | A43B 3/44 36/50.1 |

OTHER PUBLICATIONS

International Preliminary Report on Patentability received for PCT Patent Application No. PCT/US2021/021815, dated Sep. 22, 2022, 10 pages.

* cited by examiner

FOOTWEAR ARTICLE WITH HINGED HEEL

CROSS-REFERENCE TO RELATED APPLICATIONS

This application claims priority to U.S. Provisional Patent App. No. 62/989,185, filed Mar. 13, 2020, and titled "Footwear Article with Hinged Heel." This application is assigned to the same entity as the present application, and is incorporated herein by reference in the entirety.

TECHNICAL FIELD

This disclosure relates to a footwear upper having a hinged portion in a heel region that may be biased in various positions to increase or decrease a size of a foot-insertion opening.

BACKGROUND

A footwear article typically includes an upper connected to a sole, the upper and sole enclosing a foot-receiving cavity. The upper may include an opening (e.g., ankle opening) through which a foot may pass when being inserted into, or removed from, the foot-receiving cavity. In some instances, a collar around the opening may be adjusted to change a size of the opening. For example, the size of the opening may be enlarged to allow for easier donning or doffing, may be reduced to secure the upper to the foot, or any combination thereof.

BRIEF DESCRIPTION OF THE DRAWINGS

Some subject matter described in this disclosure includes a footwear upper having a hinged portion in a heel region that may be biased in various positions to increase or decrease a size of a foot-insertion opening. This subject matter is described in detail below with reference to the drawing figures, which are submitted together with this Specification and are incorporated herein by reference.

DETAILED DESCRIPTION

Figure 1:
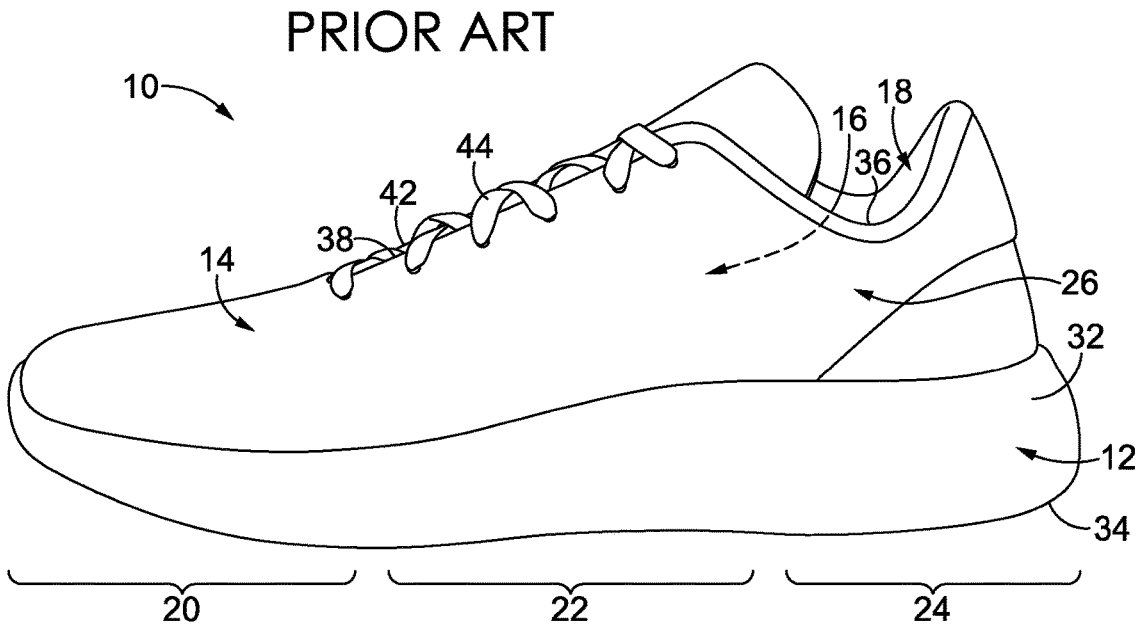
FIG. 1 includes an elevation view of a lateral side of a footwear article in accordance with an aspect of the present disclosure.

Subject matter is described throughout this Specification in detail and with specificity in order to meet statutory requirements. The aspects described throughout this Specification are intended to be illustrative rather than restrictive, and the description itself is not intended necessarily to limit the scope of the claims. Rather, the claimed subject matter might be practiced in other ways to include different elements or combinations of elements that are equivalent to the ones described in this Specification and that are in conjunction with other present technologies or future technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to, among other things, a footwear upper having a hinged portion in a heel region that may be biased in various positions to increase or decrease a size of a foot-insertion opening. In some aspects, the upper includes a collar (e.g., ankle collar) at least partially circumscribing the foot-insertion opening. In addition, a hinge attaches a heel flap to the collar, such that the heel flap can rotate on the hinge between different positions. For example, the heel flap may be arranged in a first position, in which the heel flap is more upright or forwardly rotated and is in position to cup a rear or posterior portion of a wearer's leg, ankle, or foot (e.g., a wearer's heel or Achilles region) when the footwear article is worn. In addition, the heel flap may be hingedly rotated downward or rearwardly (e.g., away from the foot-insertion opening) to a second position, which may increase a size of the foot-insertion opening and/or may change an angle along which a foot can pass through the foot-insertion opening when the footwear article is being donned or doffed. In a further aspect, one or more elastic members are attached to the heel flap and to some other portion of the footwear article. For example, the one or more elastic members may attach to the heel flap and to the medial side and/or lateral side of the footwear article. The one or more elastic members apply a force to the heel flap as the heel flap is adjusted between different positions. For example, when the heel flap is in the first position, a force applied by the elastic member(s) may assist with retaining the heel flap in the first position by biasing the heel flap towards the foot-insertion opening. In addition, when the heel flap is rotated rearwardly to the second position, a force applied by the elastic member may assist with retaining the heel flap in a downward, rearwardly rotated position, which may reduce the likelihood of inadvertent closing that may obstruct the foot-insertion opening, reduce a size of the foot-insertion opening, and/or limit angles along which a foot may pass through the foot-insertion opening.

Before describing the figures in more detail, some additional explanation will now be provided related to certain terminology that may be used in this disclosure.

"A," "an," "the," "at least one," and "one or more" might be used interchangeably to indicate that at least one of the items is present. When such terminology is used, a plurality of such items might be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated materials, features, steps, operations, elements, or components, but do not preclude the presence or addition of one or more other materials, features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

The phrases "formed from" and "formed of" are also intended throughout this disclosure and the accompanying claims to be inclusive, and to specify the presence of stated materials, features, steps, operations, elements, or components, but to not preclude the presence or addition of one or more other materials, features, steps, operations, elements, or components unless otherwise indicated.

For consistency and convenience, directional adjectives might be employed throughout this detailed description corresponding to the illustrated examples. Ordinary skilled artisans will recognize that terms such as "above," "below," "upward," "downward," "top," "bottom," etc., may be used descriptively relative to the figures, without representing limitations on the scope of the inventive embodiments described in this Specification, and as further defined by the claims.

The term "longitudinal," as possibly used throughout this detailed description and in the claims, refers to a direction extending along a length of a component; that is, aligned with its longest dimension, unless otherwise indicated. For example, a longitudinal direction of a shoe extends from a forefoot region toward a heel region of the shoe, or vise-versa. In some instances, a 'longitudinal' axis of a component may be designated with reference to and aligned with a longitudinal axis of another component or of a structure of which the component is a part, and will be so described for clarity. The terms "forward" or "anterior" are used to refer to the general direction from a heel region toward a forefoot region, and the terms "rearward" or "posterior" are used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse," as possibly used throughout this detailed description and in the claims, refers to a direction extending across a width of a component. For example, a transverse direction of a shoe extends from a lateral side toward a medial side of the shoe, or vise-versa. The transverse direction or axis may also be referred to as a lateral direction or axis or a mediolateral direction or axis.

The term "vertical," as possibly used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region, and/or a throat of an upper. The term "downward" or "downwards" refers to the vertical direction pointing opposite the upwards direction, toward the bottom of a component, and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of an assembled article of footwear. The "outer side" or "exterior" of a component refers to the side or surface of the component that is (or will be) oriented away from the interior of an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as a shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

In describing a footwear article, the relative terms "inferior" and "superior" may also be used. For example, the superior portion generally corresponds with a top portion that is oriented closer towards a person's head when the person's feet are positioned flat on a horizontal ground surface and the person is standing upright, whereas the inferior portion generally corresponds with a bottom portion oriented farther from a person's head and closer to the ground surface.

In other instances, standard anatomical terms of orientation may be used to describe a footwear article. For example, the footwear article may be described in terms of including a coronal plane, a sagittal plane, and an axial (transverse) plane. The coronal plane extends vertically and in a longitudinal orientation, such that the coronal plane may divide the footwear article into a relative medial side and a relative lateral side. The sagittal plane also extends vertically, but in contrast to the coronal plane, extends in the transverse orientation, and may divide the footwear article into a relatively anterior or front portion and a relatively posterior or back portion. The axial (transverse) plane extends general horizontally, and may divide the footwear article into a relatively superior or top portion and a relatively inferior or bottom portion. It is further understood that the referential axes and planes described in this disclosure, when used in relation to the shoe, remain fixed relative to the shoe, and rotate in space with the shoe as the shoe rotates. For example, the vertical axis of the shoe remains the vertical axis of the shoe irrespective to any change in the orientation of the shoe in space at any given time.

Figure 2:
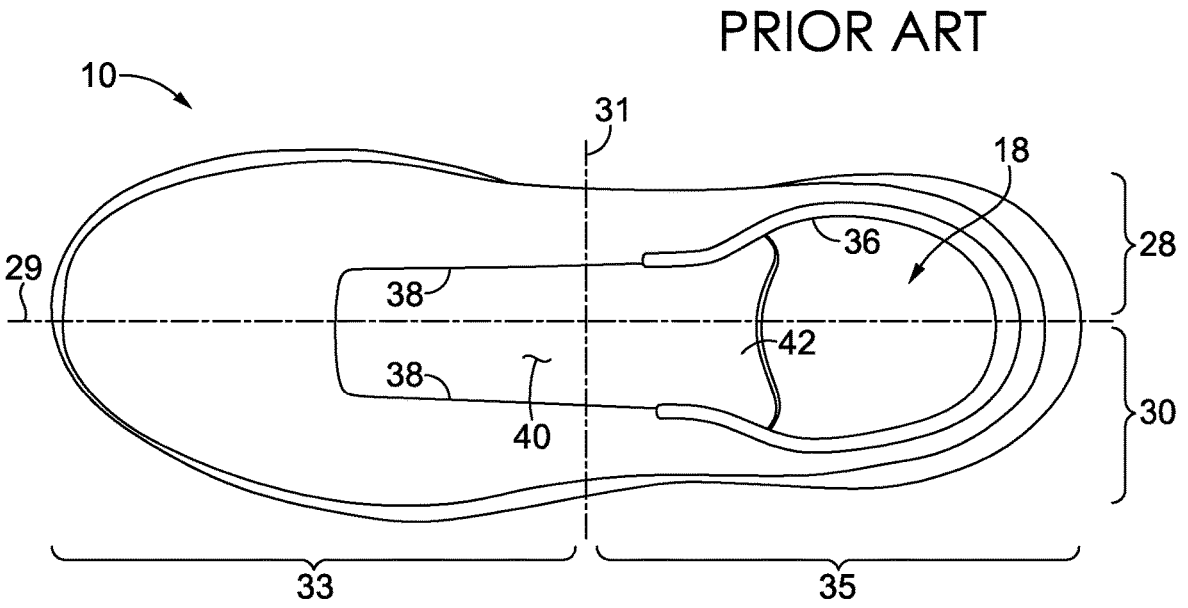
FIG. 2 includes a plan view of the footwear article of FIG. 1 in accordance with an aspect of the present disclosure.

In order to aid in the explanation of, and understanding of, aspects of this Specification, reference is now made to FIGS. 1 and 2 to describe elements of a typical footwear article 10. FIG. 1 depicts a lateral side of the footwear article 10, and FIG. 2 depicts a top of the footwear article. When describing the various figures mentioned in this disclosure, like reference numbers refer to like components throughout the views.

The footwear article 10 includes at least two primary elements including a sole structure 12 and an upper 14. When the footwear article 10 is worn (as intended on a foot), the sole structure 12 is typically positioned near the foot plantar surface (i.e., the bottom of the foot). The sole structure 12 may protect the bottom of the foot, and in addition, may attenuate ground-reaction forces, absorb energy, provide traction, and control foot motion, such as pronation and supination. The upper 14 is coupled to the sole structure 12, and together with the sole structure 12, forms a foot-receiving cavity 16. That is, while the sole structure 12 typically encloses the bottom of the foot, the upper 14 extends over, and at least partially covers, a dorsal portion of the foot (i.e., the top of the foot or the instep) and secures the footwear article 10 to the foot. The upper 14 includes a foot-insertion opening 18, through which a foot is inserted when the footwear article 10 is put on as the foot is arranged into the foot-receiving cavity 16.

As indicated in FIG. 1, the footwear article 10 may include a forefoot region 20, a midfoot region 22, a heel region 24, and an ankle region 26. The forefoot region 20, the midfoot region 22, and the heel region 24 extend through the sole structure 12 and the upper 14. The ankle region 26 is located in a portion of the upper 14. The forefoot region 20 generally includes portions of the footwear article 10 corresponding with the toes and the joints connecting the metatarsals with the phalanges. The midfoot region 22 generally includes portions of the footwear article 10 corresponding with the arch area and instep of the foot. The heel region 24 corresponds with rear portions of the foot, including the calcaneus bone. The ankle region 26 corresponds with the ankle. The forefoot region 20, the midfoot region 22, the heel region 24, and the ankle region 26 are not intended to demarcate precise areas of the footwear article 10, and are instead intended to represent general areas of the footwear article 10 to aid in the understanding of various aspects of this Specification. In addition, portions of a footwear article may be described in relative terms using these general zones. For example, a first structure may be described as being more heelward than a second structure, in which case the second structure would be more toeward and closer to the forefoot.

The footwear article 10 also has a medial side 28 (identified in FIG. 2 and obscured from view in FIG. 1) and a lateral side 30 (identified in FIG. 2 and viewable in FIG. 1). The medial side 28 and the lateral side 30 extend through each of the forefoot region 20, the midfoot region 22, the heel region 24, and the ankle region 26, and correspond with opposite sides of the footwear article 10, each falling on an opposite side of a longitudinal midline reference plane 29 of the footwear article 10, as is understood by those skilled in the art. For example, the longitudinal midline reference plane 29 may pass through the foremost point of the sole structure and the rearmost point of the sole structure. The medial side 29 is thus considered opposite to the lateral side 30. Typically, the lateral side corresponds with an outside area of the foot (i.e., the surface that faces away from the other foot), and the medial side corresponds with an inside area of the foot (i.e., the surface that faces toward the other foot). In another aspect, the footwear article includes an anterior portion 33 and a posterior portion 35, falling on an opposite side of a latitudinal midline reference plane 31 of the footwear article 10. The latitudinal midline reference plane 31 extends perpendicular to the longitudinal midline reference plane 29 and to the ground-surface plane and is spaced evenly between the foremost point of the footwear article 10 and the rearmost point of the footwear article 10. In addition, these terms may also be used to describe relative positions of different structures. For example, a first structure that is closer to the inside portion of the footwear article might be described as medial to a second structure, which is closer to the outside area and is more lateral.

The sole structure 12 may be constructed of various materials and may include various elements. For example, the sole structure 12 may include a midsole 32 and an outsole 34. The midsole 32 may be formed from a compressible polymer foam element (e.g., a polyurethane or ethylvinylacetate (EVA) foam) that attenuates ground reaction forces (i.e., provides cushioning) when compressed between the foot and the ground during walking, running, or other ambulatory activities. In further aspects, the midsole 32 may incorporate fluid-filled chambers, plates, moderators, or other elements that further attenuate forces, enhance stability, or influence motions of the foot. The midsole 32 may be a single, one-piece midsole, or could be multiple components integrated as a unit. In some aspects, the midsole 32 may be integrated with the outsole 34 as a unisole. The outsole 34 may be one-piece, or may be several outsole components, and may be formed from a wear-resistant rubber material that may be textured to impart traction and/or may include traction elements such as tread or cleats secured to the midsole 32. The outsole 34 may extend either the entire length and width of the sole or only partially across the length and/or width.

The upper 14 may also be constructed of various materials and may include various features. For example, the upper 14 may be constructed of leather, textiles, or other synthetic or natural materials. Further, the upper 14 may be a knit textile, woven, braided, non-woven, laminate, or any combination thereof. The upper 14 may have various material properties related to breathability, stretch, flexibility, wicking, water resistance, and the like.

The upper 14 typically includes a portion that overlaps with, and is connected to, the sole structure 12, and the junction of this connection may be referred to as a biteline. In addition, the upper 14 may include a "strobel," which includes a material panel extending from the upper 14 and across at least a portion of a foot-facing surface of the sole structure 12, and the strobel may be used to hold the upper 14 on a last when the sole structure 12 is attached to the upper 14. Stated differently, the sole structure 12 that is integrated into the footwear article 10 includes a foot-facing surface, and in some instances, the upper 14 may include a panel (referred to as a strobel) that extends inward from near the biteline region and at least partially covers the foot-facing surface. In that instance, the strobel is positioned underneath a foot when the footwear article is worn. The strobel may be covered by an insole or other layer of material.

The upper 14 includes other features. For example, the upper 14 includes an ankle collar 36 that forms a perimeter around at least a portion of the foot-insertion opening 18. In FIGS. 1 and 2, the ankle collar 36 continuously extends from the medial side, around the back of the upper, to the lateral side. However, the ankle collar 36 may include one or more cutouts that enlarge the foot-insertion opening 18, and the ankle collar 36 may include a different shape or profile, such as in a mule or clog with a short heel band wrapping from the medial side to the lateral side. In addition, the upper 14 includes a throat 38 that often extends from the ankle collar 36 and forms a perimeter along at least one or more sides of an elongated opening 40. A tongue 42 is located in the elongated opening 40, and a size of the elongated opening 40 can be adjusted using various closure systems. For example, FIG. 1 illustrates laces 44, and other closure systems may include elastic bands, hook-and-loop straps, zippers, buckles, and the like. The position of the tongue 42 and the connections of the closure system can be adjusted to vary a size of the foot-insertion opening and the elongated opening, such as by making the openings larger when the footwear article is being donned or doffed and by making the openings smaller when the footwear article is being secured onto a foot.

The footwear article 10 might include an athletic-type shoe, such as might be worn when running or walking, and the description of the footwear article 10, including the elements described with respect to FIGS. 1 and 2, might also be applicable to other types of shoes, such as basketball shoes, tennis shoes, American football shoes, soccer shoes, leisure or casual shoes, dress shoes, work shoes, a sandal, a slipper, a boot, hiking shoes, and the like.

Referring now to FIGS. 3-7, an example of a footwear article 110 is depicted with an upper 114 having a hinged portion (e.g., heel flap 150) in a heel region that may be biased in various positions to increase or decrease a size of a foot-insertion opening 118. Except as otherwise described, the footwear article 110 may include many of the same or similar elements described with respect to FIGS. 1 and 2. The footwear article 110 includes an upper 114 coupled to a sole 112, and the upper 114 includes a collar 136 (e.g., ankle collar). The collar 136 at least partially circumscribes a foot-insertion opening 118.

Figure 3:
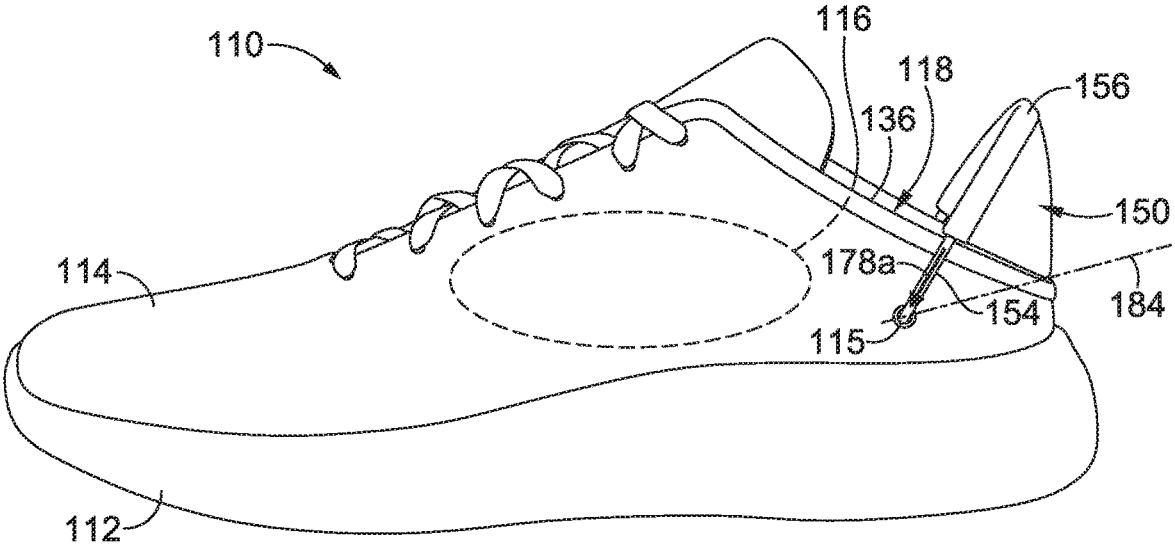
FIG. 3 includes an elevation view of a lateral side of a second footwear article having a hinged heel flap with an elastic cord in accordance with an aspect of the present disclosure.
Figure 4:
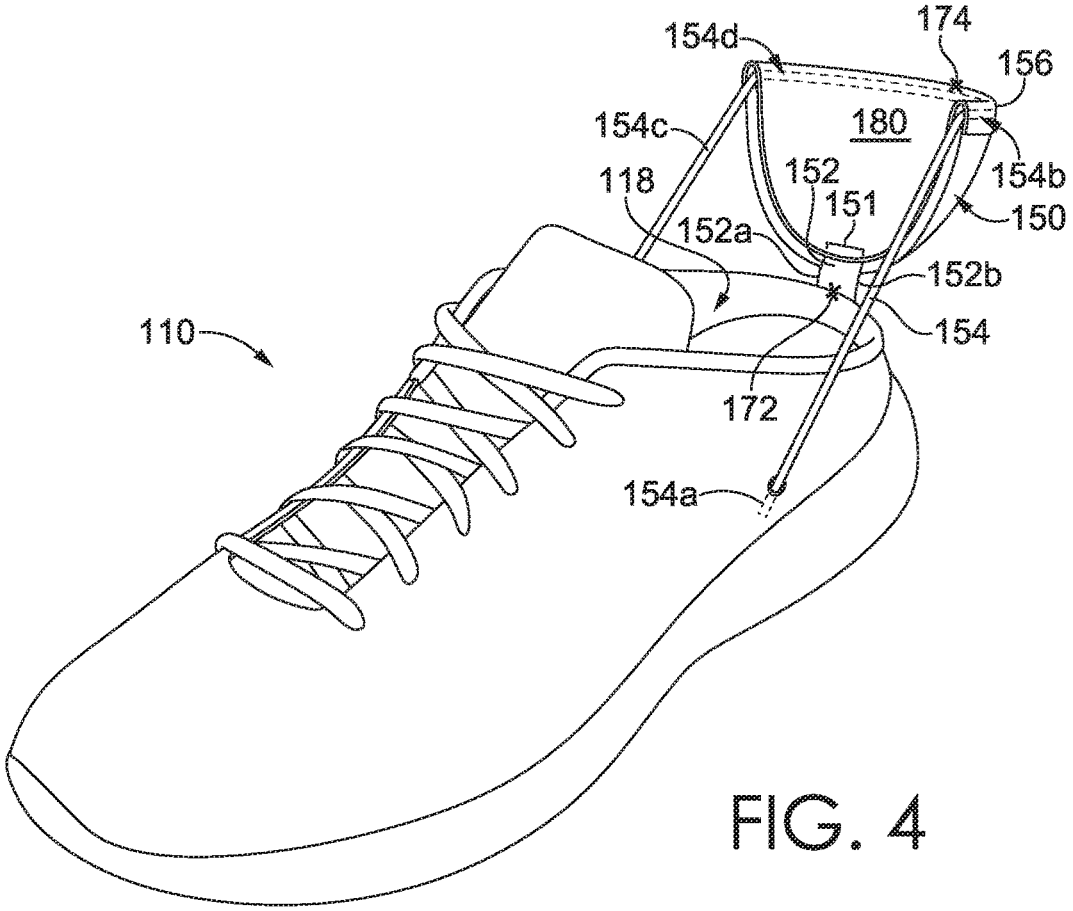
FIG. 4 includes a perspective view of the second footwear article with the hinged heel flap rotated rearward in accordance with an aspect of the present disclosure.
Figure 5:
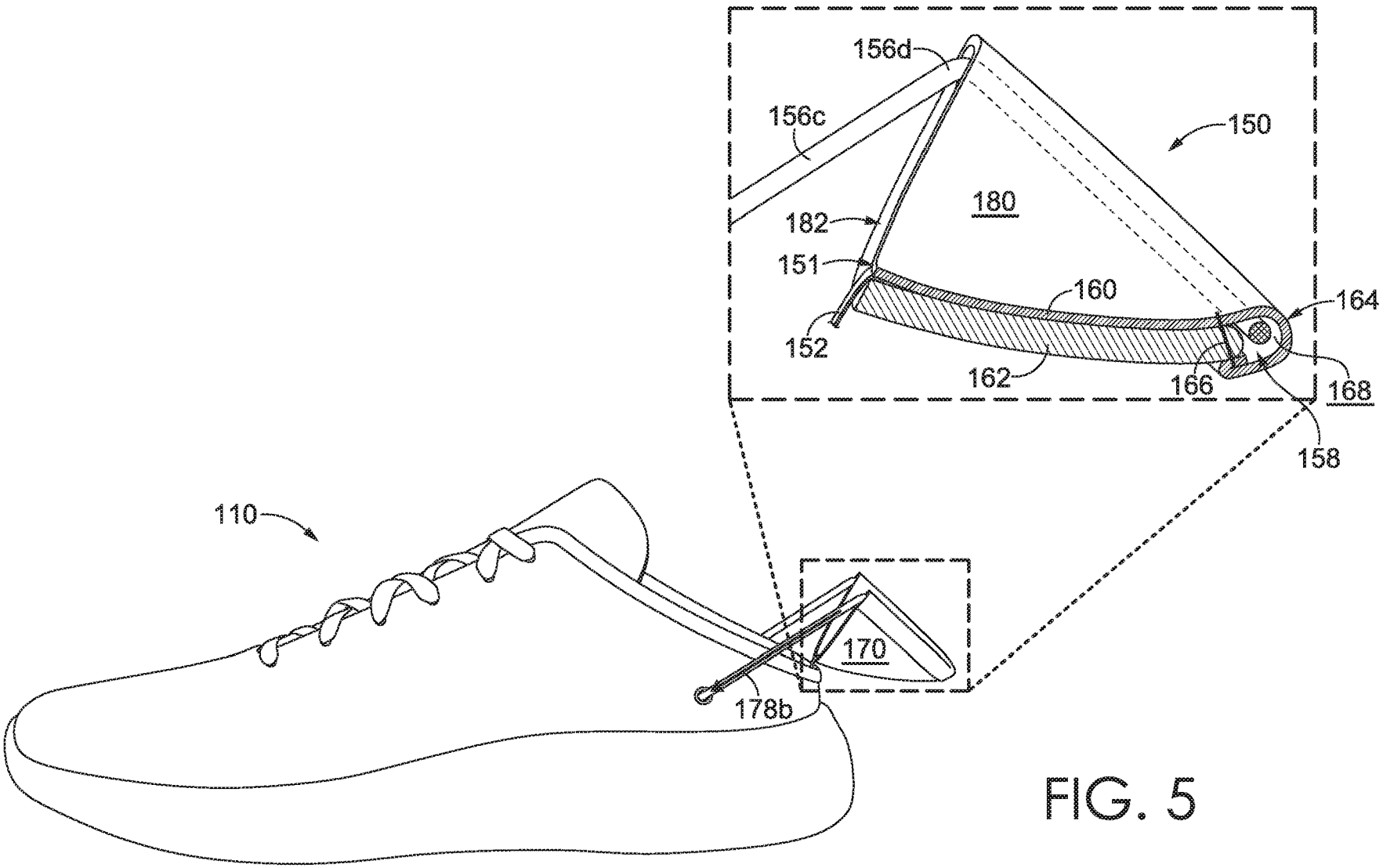
FIG. 5 includes an elevation view of the second footwear article with the hinged heel flap rotated further rearward and includes a cross-sectional view of the heel flap in accordance with an aspect of the present disclosure.
Figure 6:
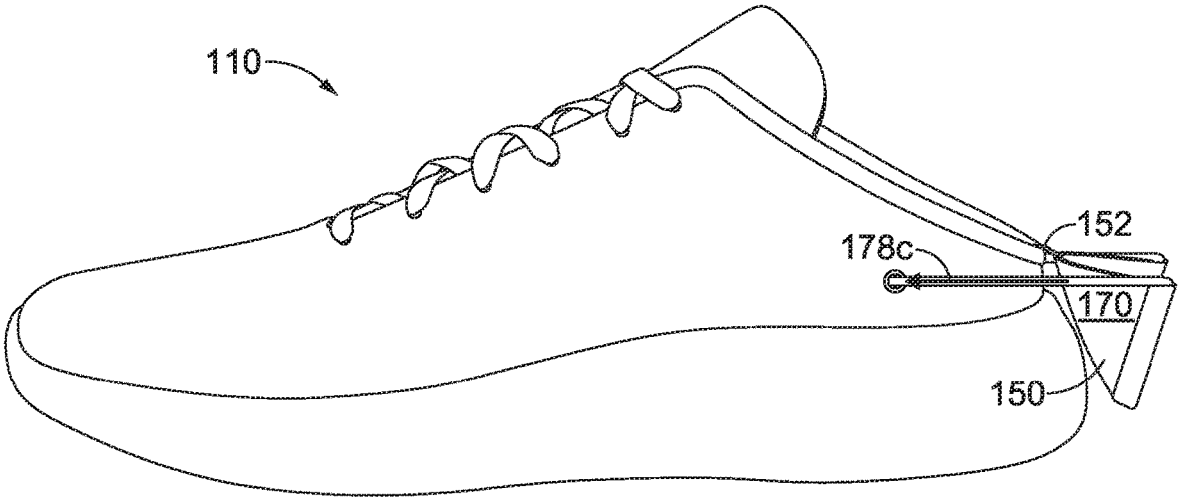
FIG. 6 includes an elevation view of the second footwear article with the hinged heel flap rotated further rearward in accordance with an aspect of the present disclosure.

In addition, the footwear article 110 includes a heel flap 150 attached to the upper 114 by a hinge 152. The heel flap 150 is moveable between various positions by rotating on the hinge 152. For example, FIG. 3 depicts a first position in which the heel flap 150 is more upright and forwardly rotated and is in position to cup a wearer's heel or Achilles region when the footwear article 110 is worn. In addition, the heel flap 150 may be hingedly rotated downward or rearwardly (e.g., away from the foot-insertion opening 118 and clockwise based on the view in FIG. 3) to a second position. Rotating the heel flap in this manner may increase a size of the foot-insertion opening 118, change an angle along which a foot can pass through the foot-insertion opening 118 when the footwear article is being donned or doffed, or any combination thereof. The hinge 152 may comprise various elements, such as a textile strip (e.g., leather, polymer sheet, knit, woven, nonwoven, etc.). As shown in FIGS. 4 and 5, the hinge 152 may be attached to an edge segment 151 of the heel flap 150 and may be affixed between the layers 160 and 162, such as with bonding or with some other connector (e.g., stitching). In other aspects, the hinge 152 may be affixed along the edge segment 151 to the surface 180 or the surface 170.

In a further aspect, the footwear article 110 includes an elastic member 154 attached to one or more portions of the footwear article 110 and to the heel flap 150. The elastic material may include various forms, such as an elongated form in which a dimensional length is larger than a dimensional width, such as a cord, cable, strap, strip, panel, ribbon, etc. In FIGS. 3-7, the elastic member 154 includes an elastic cable or elastic cord. In FIGS. 3-7, the elastic member 154 includes a first portion **154*a* attached to the lateral side 130 of the upper, and a second portion 154*b* attached to the heel flap 150. In addition, the elastic member 154 includes a third portion 154*c* on the medial side of the upper, and the third portion 154*c* includes a fourth portion 154*d* attached to the heel flap. The third portion 154*c* may also attach to the medial side in a manner similar to the first portion 154*a* attached to the lateral side (obscured from view in the figures). The first portion 154*a*, the second portion 154*b*, and the fourth portion 154*d* are drawn in dashed lines to illustratively convey that, in at least some aspects, that portion of the elastic member 154 may be obscured from view by a portion of the upper 114 or heel flap 150. In one aspect, the elastic member 154 may be a single, continuous member extending from the first portion 154*a* attached to the lateral side of the upper 114, through the connection to the heel flap 150, to the third portion 154*c* on the medial side. In other aspects, the elastic member 154** may include a first member on the medial side of the upper and a second member on the medial side of the upper, discontinuous with the first member.

The elastic member 154 may attach to the upper 114 and the heel flap 150 in various manners. For example, the first portion **154*a* may pass through an aperture 115 in an outer layer of the upper 114 and be secured to the upper 114 (e.g., at a location interior to the outer layer) using various connectors, such as a stitch, bonding, welding, etc. Other types of connectors may include a toggle attached to the first portion 154*a* (e.g., on the inside of the outer layer obscured from view) that impedes the first portion 154*a* from being pulled from the aperture 115. A toggle may permit the elastic member 154 to remain attached to the upper 114 and to rotate relative to the aperture 115. Alternatively, a releasable fastener may be used to connect the first portion 154*a* to the upper 114, such as a hook-and-loop fastener, clip, snap, etc. In FIGS. 3-7, the first portion 154*a* is depicted attached to the upper 114, and in other aspects, the first portion 154*a* may be attached to the sole 112, between the upper 114 and the sole 112 (e.g., near the biteline), or any combination thereof. Similarly, the third portion 154*c* may attach on the medial side to the upper 114, to the sole 112, between the upper 114 and the sole 112** (e.g., near the biteline), or any combination thereof.

In further aspects of this disclosure, the second portion 154*b* of the elastic member 154 is attached to the heel flap 150 by a fixed-state connector 156. As used in this disclosure, a fixed-state connector is connector having a connected state without repeated convertibility back-and-forth between the connected state and a disconnected state. That is, once connected, a fixed-state connector is typically not releasable or disconnectable in a manner that permits the fixed-state connector to be re-connected in the same form, and often times, disconnecting a fixed-state connector weakens or destroys the integrity of the connector. Some examples of fixed-state connectors include stitches, bonds, welds (e.g., sonic welding), heat-stakes, rivets, etc., which could be applied to the heel flap 150, to the elastic member 154, and to any combination thereof. For example, once a stitch, a bond, a weld, a heat stake, or a rivet is connected in position, the mechanism is typically not releasable and then reconnectable in a same condition.

In FIGS. 3-7 the fixed-state connector 156 includes an encasement sleeve having a channel 158 (FIG. 5) through which the elastic member 154 extends. The encasement sleeve includes one or more material layers that wrap around, or otherwise enclose, the elastic member 156. For example, in FIGS. 3-7 the heel flap 150 includes a first material layer 160 and a second material layer 162. When the heel flap is in the first position (e.g., more upright and forwardly rotated as shown in FIG. 3), then the first material layer 160 is more interior (e.g., closer to the foot-receiving cavity), relative to the second material layer 162. For example, the first material layer 160 may be a liner material layer. Referring to FIG. 5, a cross-sectional view of the heel flap 150 depicts both the first material layer 160 and the second material layer 162. In one aspect, the first material layer 160 extends from the relatively interior position to the topline edge 164 of the heel flap 150, at which point the first material layer 160 folds or wraps from the relatively interior position to a relatively exterior position and attaches to the second material layer 162 with a connector 166. For example, in FIG. 5, the connector includes a stitch, and in other aspects, the connector 166 may include another type of fixed-state connector, such as a bond, rivet, heat stake, etc.). By the first material layer 160 wrapping from the relatively interior position to the relatively exterior position and attaching to the second material layer 162 with a fixed-state connector 166, the encasement sleeve is provided along the collar of the heel flap 150 near the topline edge 164. In addition, the encasement sleeve includes an interior surface 168 that faces towards the elastic member 154.

Other arrangements of material layers may also form an encasement sleeve. For example, in an alternative aspect, the second material layer 162 may wrap from a relatively exterior position to a relatively interior position and attach to the first material layer 160 to form an encasement sleeve. Alternatively, the first material layer and the second material layer may each extend to the topline edge 164, at which a first connector may attach the two material layers (e.g., above the elastic member 154). In that case, a second connection between the first material layer and the second material layer may be positioned below the elastic member 154, such that the elastic member 154 is positioned between the first and second connectors (e.g., fixed-state connectors). In yet another aspect, a single material layer may extend upwards from a bottom edge 182 of the heel flap, fold or wrap over the elastic member 154 near the topline edge 164, and be connected back onto itself below the elastic member 154 (e.g., with a stitch, bonding, welding, etc.). In each of these alternatives, the encasement sleeve includes an interior surface facing towards the elastic member.

In an aspect of the present disclosure, the interior surface 168 is free to slide circumferentially around the elastic member when the heel flap 150 rotates on the hinge 152. That is, as the heel flap 150 rotates on the hinge 152 from the more upright, forwardly rotated position in FIG. 3 to the downward, rearwardly rotated position in FIG. 7, the interior surface 168 orbits around the elastic member 154 (e.g., retrograde motion). As used herein, the term orbit or retrograde motion or retrograde orbit describes the relative rotational motion of the interior surface 168 relative to the elastic member 154—the interior surface 168 may rotate while the elastic member does not rotate, the elastic member 154 may rotate while the interior surface 168 does not rotate, and/or the interior surface 168 and the elastic member 154 may rotate in opposite directions. The orbital or retrograde motion of the interior surface 168 relative to the elastic member 154 may reduce the torsional forces that might otherwise be created in the elastic member 154 (such as if the elastic member 154 were stitched, bonded, secured against, or otherwise coupled directly to the interior surface 168) and that might undesirably bias the heel flap 150 towards the upright position—e.g., torsional strain may increase the likelihood that the heel flap 150 inadvertently flips from the position in FIG. 7 to the position in FIG. 3. The heel flap 150 may include additional elements to facilitate smooth orbital motion, such as a reinforcement tube or sleeve inside the encasement sleeve, or lower friction materials applied to the interior surface 168 or to the elastic member 154. In addition, the cross-section shape of the elastic member may also contribute to the retrograde motion of the encasement sleeve, relative to the elastic member. For example, a circular or ovular cross-section (as shown in FIG. 5) may be less likely to impede the retrograde motion, as compared with a ribbon or rectangular cross-section.

The encasement sleeve depicted in FIGS. 3-7 is one example of a fixed-state connector that retrogradely rotates around the elastic member 154. In other aspects, a different connector type may attach the elastic member 154 to the heel flap and permit the retrograde rotation. For example, a round tubular structure may be affixed to the exterior surface 170 or the interior surface 180 of the heel flap 150, and the elastic member 154 may extend through the round tubular structure. In another example, a first aperture may be positioned on a lateral side of the heel flap 150, and a second aperture may be positioned on a medial side of the heel flap 150. In this example, a lateral elastic member may attach to the heel flap 150 by extending through the first aperture, with a first toggle-type fastener (e.g., bead, knot, crimp sleeve, etc.) to impede the lateral elastic member from being pulled from the aperture. Similarly, a medial elastic member may attach to the heel flap by extending through the second aperture, with a second toggle-type fastener to impede the medial elastic member from being pulled from the second aperture. In this alternative version, the toggle-fastener connection still permits the lateral and medial elastic members and the first and second apertures to retrogradely rotate relative to one another as the heel flap 150 transitions between positions. In yet another aspect, a respective swivel connector may attach a lateral elastic member and a medial elastic member to the heel flap, in which case the swivel connector may also permit a rotational connection. This swivel-provided rotational connection may permit the elastic member to rotate, relative to the heel flap 150 (or vice versa), as the heel flap 150 transitions between positions, and this relative rotation (e.g., retrograde orbit of one part of swivel around another part) may reduce torsional forces along the elastic member, the heel flap, or any combination thereof.

The hinge 152 might be attached at various locations along the collar 136. For example, in FIGS. 3-7, the hinge is attached to the collar 136 along a segment of the collar that intersects a vertical, longitudinal reference plane of the footwear article (e.g., plane 29 of FIG. 2). However, in other aspects of the present disclosure, the hinge and the heel flap may be offset to the medial side or to the lateral side. For example, in some instances, the hinge and the heel flap may be offset to create a larger foot-insertion opening along a foot-entry path that is not a straight on with the longitudinal direction of the footwear article. The position of the hinge and the heel flap may be based on various factors, such as selecting a foot-insertion opening configured to fit a prosthetic or brace or other equipment (e.g., ankle guard, shin guard, etc.).

Figure 7:
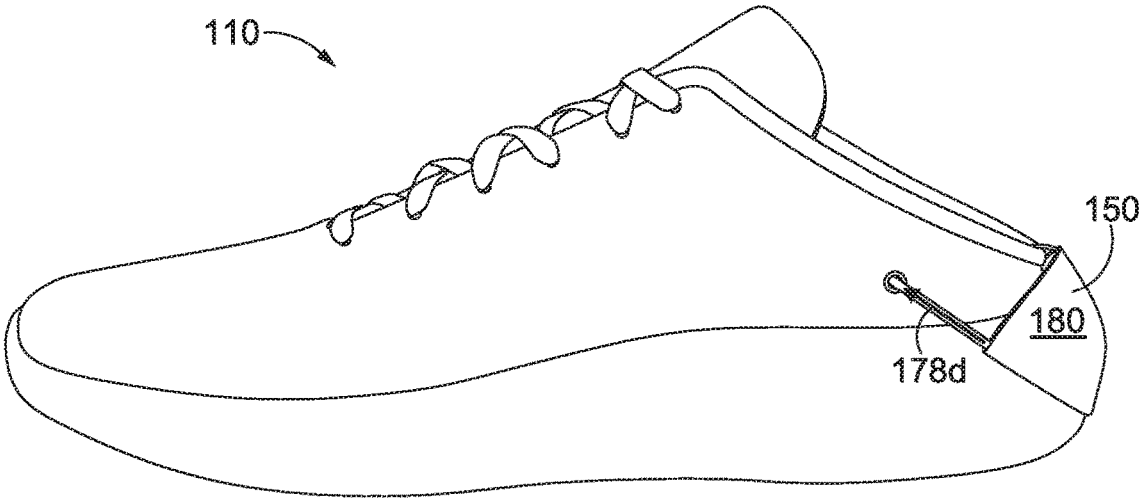
FIG. 7 includes an elevation view of the second footwear article with the hinged heel flap rotated rearward and flipped to compress against a sole of the second footwear article in accordance with an aspect of the present disclosure.

The footwear article 110 may include other elements as well. As depicted in FIG. 3, the footwear article 110 includes the heel flap 150 in the first position, which is more upright, forwardly rotated, biased by the elastic member 154 pulling the heel flap 150 towards the foot-receiving cavity 116. In the first position, the heel flap 150 at least partially obscures the foot-insertion opening 118, which may reduce a size of the foot-insertion opening 118 and may limit angles from which a foot may be inserted or removed from the foot-receiving cavity 116. The first position in FIG. 3 may also be referred to as a closed position or state. In addition, as depicted in FIG. 7, the footwear article 110 includes the heel flap 150 in a second position, which is more downward and/or rearward, as the heel flap 150 has been rotated rearwardly on the hinge 152 away from the foot-receiving cavity 116, in a clockwise direction (based on the view in FIG. 3). In the second position, the heel flap 150 is biased against the heel portion of the sole 112 by the elastic member 154 pulling the heel flap 150 towards the midsole.

In one aspect of the disclosure, the heel flap 150 may rotate by 90 degrees or more as the heel flap 150 transitions from the first position to the second position, at which point the amount of rotation is limited by contact with the sole. In another aspect, the heel flap 150 may rotate by 135 degrees or more as the heel flap transitions from the first position in FIG. 3 to the second position depicted in FIG. 7, at which point the amount of rotation is limited by contact with the sole. The amount of rotation may be measured using various techniques. For example, in one technique, a hinge reference point 172 is identified on the topline of the collar 136 that is equidistant from the sides 152*a* and 152*b* of the hinge 152. A rotation reference point 174 may be determined along the topline edge 164 of the heel flap 150, and the rotation reference point 174 is in a reference plane extending perpendicular to the axis of rotation of the heel flap 150 and coplanar with the hinge reference point 172. The hinge reference point 172 may comprise a vertex with a first arm being formed between the vertex and the rotation reference point 174 in the first position and a second arm being formed between the vertex and the rotation reference point 174 in the second position. In one aspect, the angle between the first arm and the second arm provides a degree of rotation of the heel flap 150 between two positions.

Based on the lateral side perspective provided in FIGS. 3-7, the elastic member 154 may bias the heel flap 150 to rotate on the hinge 152 either counterclockwise (e.g., forwardly, towards the foot-receiving cavity 116) or counterclockwise (e.g., rearwardly, towards the sole 112), depending on a position of the heel flap 150 and the elastic member 154 relative to the hinge 152. For example, when the heel flap 150 is in the first position shown in FIG. 3, the elastic member 154 biases the heel flap 150 to rotate counterclockwise, forwardly towards the foot-receiving cavity 116. A similar, counterclockwise bias also occurs in the positions represented in FIGS. 4 and 5, in which, even if the heel flap 150 is pulled rearwadly a little (such as by a wearer with his/her foot or hand), the elastic member 154 will still pull the heel flap 150 back towards the foot-receiving cavity 116 (e.g., to a "closed" state). At the positions represented in FIGS. 3, 4, and 5, the force vector 178*a* and 178*b* of the elastic member 154 is still superior to the hinge 152, which, when applied to the heel flap 150, continues to pull the heel flap 150 forwardly. This automatic return action provided by the elastic member 154 may assist with easier donning or doffing by temporarily increasing a size of the foot-insertion opening 118 and automatically returning the heel flap 150 to a closed position. In a further aspect, once the heel flap 150 has been rotated rearwardly far enough (e.g., such as by a wearer using his/her foot or hand), the directional or rotational bias of the force applied by the elastic member 154 changes, such that the elastic member 154 biases the heel flap 150 to rotate in a clockwise direction, rearwardly towards the sole. For example, in FIGS. 6 and 7, the heel flap 150 has been rotated rearwardly far enough that the force vector 178*c* and 178*d* is now inferior to the hinge 152, such the heel flap is biased rearwadly and open.

In a further aspect, when the heel flap 150 is in the first position of FIG. 3, the elastic member 154 applies a first force to the heel flap 150, the first force having a first force vector 178*a* pointing towards the first portion 154*a* of the elastic member 154 attached to the upper (or to some other portion of the footwear article 110). In one aspect, the first position may include a bottom edge 182 of the heel flap 150 contacting at least a portion of the ankle collar 136. In the second position (e.g., FIG. 7), the elastic member 154 applies a second force to the heel flap, the second force including a second force vector 178*d* also pointing towards the first portion 154*a* of the elastic member 154. In another aspect, in the first position of FIG. 3, the heel flap 150 includes an interior surface (see e.g., reference number 180 in FIG. 4) facing towards the foot-receiving cavity 116, and in the first position, the interior surface 180 is concave. Furthermore, in the second position of FIG. 7, the interior surface 180 faces away from the footwear article and is convex, with the exterior surface 170 being concave, which may further conform to the footwear article and assist with retaining the heel flap in the more open position. Alternatively, only a portion of the surface 170 may This operation of the heel flap 150 flipping "inside-out" may arise from various elements, including the manner in which the elastic member 154 attaches to the heel flap with the encasement sleeve, as well as a force of the elastic member (e.g., compressive force) being larger than a bend strength of the heel flap 150. In addition, although FIGS. 3-7 depict the heel flap 150 flipping between the positions depicted in FIGS. 6 and 7, in reality, the flipping may more incrementally occur once the force vector 178*a-d* has move from being positioned on one side of the hinge 150 to being positioned on the other side of the hinge 152. For example, the transition of the heel flap 150 from a concave interior surface 180 to a convex interior surface 180 may more gradually occur as the force vector 178*a-d* changes from being positioned relatively superior to the hinge axis to relatively inferior to the hinge axis. Likewise, the transition of the heel flap 150 from a convex interior surface 180 to a concave interior surface 180 may more gradually occur as the force vector 178*a-d* changes from being positioned relatively inferior to the hinge axis to relatively superior to the hinge axis. Although FIG. 7 depicts the entire heel flap 150 flipping, in an alternative aspect, a portion of the heel flap 150 flips, such as the portion closest to the hinge 152, and in that case, the portion of the heel flap 150 hear the encasement sleeve may not fully flip.

The elasticity of the elastic member 154 may include various properties. For example, in one aspect, the elastic member 154 elastically deforms (e.g., elongatedly stretches) when the heel flap 150 is manipulated rearwardly (e.g., with a hand or foot of a wearer), such that the elastic member 154 is able to return to a previous condition after the force is removed. In another aspect, the elastic member 154 is able to stretch a distance under a rearwardly directed force to allow the heel flap 150 to rotate rearwardly on the hinge 152. In at least one aspect, the distance to which the elastic member 154 elastically stretches is at least such that the point at which the elastic member attaches to the upper (e.g., 115), the hinge 152 (e.g. point 172), and the point 174 are substantially coplanar (see e.g., reference line 184 in FIG. 3 illustrating an approximate location of a reference plane in which these portions would be coplanar when the elastic member 154 is elastically stretched rearward). In another aspect, the elastic member 154 may apply a force sufficient to rotate the heel flap 150 when the heel flap is at different positions. For example, in a closed state represented in FIG. 3, the elastic member 154 may actively pull the heel flap 150 towards the foot-receiving cavity. Alternatively, in the closed state, the elastic member 154 may be taut, but not actively tensed or elastically stretched.

Referring now to FIGS. 8-12, another footwear article 210 is depicted that is an alternative to the footwear article 110. Except as otherwise described in this disclosure, the footwear article 210 may have the same or similar elements to those described with respect to the footwear article 10. The footwear article 210 includes an upper 214 having a hinged portion (e.g., heel flap 250) in a heel region that may be biased in various positions to increase or decrease a size of a foot-insertion opening 218. The upper 214 includes a collar 236 (e.g., ankle collar), which at least partially circumscribes the foot-insertion opening 218.

Figure 8:
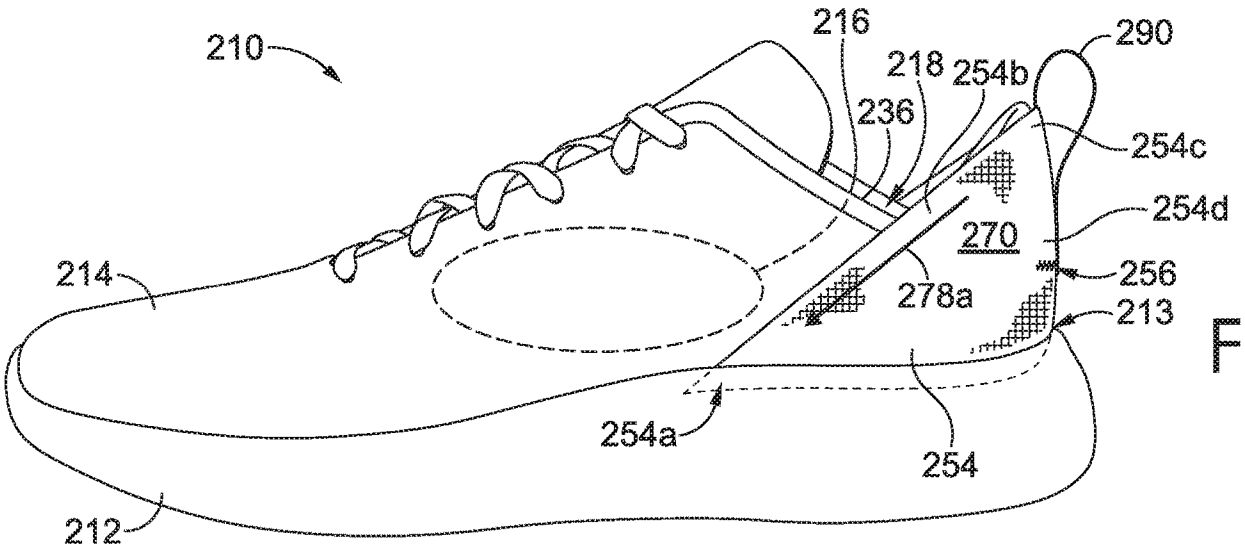
FIG. 8 includes an elevation view of a lateral side of a third footwear article having a hinged heel flap with an elastic panel or band in accordance with an aspect of the present disclosure.
Figure 9:
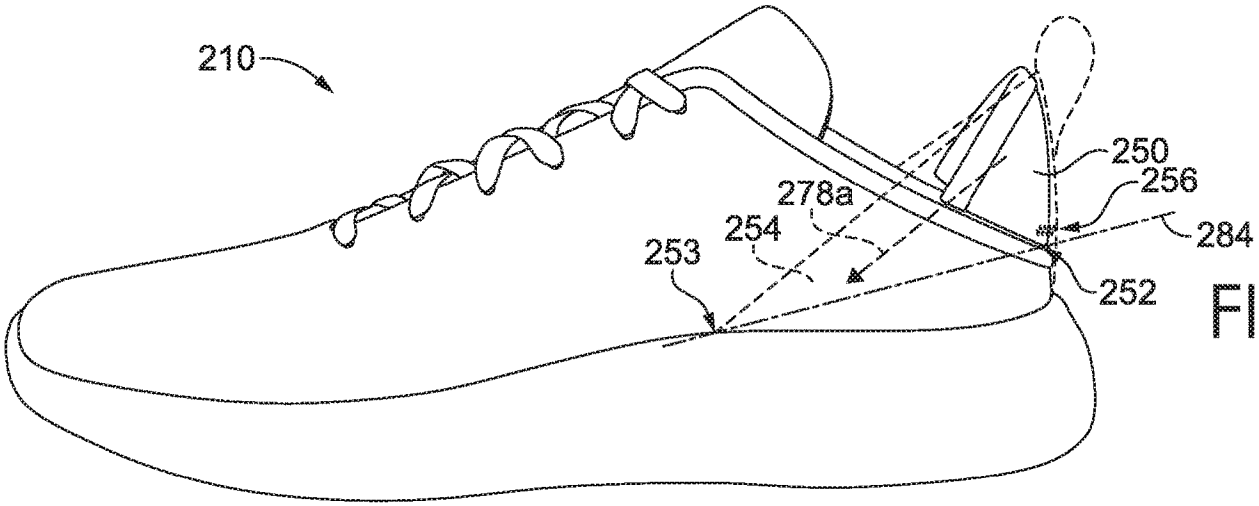
FIG. 9 includes the view of FIG. 8 with the elastic panel or band ghosted to reveal the hinged heel flap in accordance with an aspect of the present disclosure.

In addition, the footwear article 210 includes the heel flap 250 attached to the upper 214 by a hinge 252, and FIG. 9 shows a ghosted view of an elastic member 254 to provide an unobscured view of the heel flap 250 and the hinge 252, which may otherwise be obscured behind the elastic member 254 in the position represented in FIG. 8. In one aspect, the heel flap 250 and the hinge 252 are the same as, or similar to the heel flap 150 and the hinge 152 the footwear article 110. The heel flap 250 is moveable between various positions by rotating on the hinge 252. For example, FIG. 8 depicts a first position in which the heel flap 250 is more upright, is rotated forwardly, and is in position to cup a wearer's heel or Achilles region when the footwear article 210 is worn. In addition, the heel flap 250 may be hingedly rotated downward and/or rearwardly (e.g., away from the foot-insertion opening 218 and clockwise based on the view in FIG. 8) to a second position (e.g., FIG. 12). Rotating the heel flap 250 in this manner may increase a size of the foot-insertion opening 218, change an angle along which a foot can pass through the foot-insertion opening 218 when the footwear article is being donned or doffed, or any combination thereof.

In a further aspect, the footwear article 210 includes the elastic member 254 attached to one or more portions of the footwear article 210 and to the heel flap 250. In FIGS. 8-12, the elastic member 254 includes an elastic panel, and in other aspects, the elastic member may take other forms, such as an elastic band or an elastic strip. The elastic member 254 may include a variety of different elastic panels or straps. For example, the elastic member 254 may include a woven, knit, or braided textile with multi-directional stretch (e.g., bi-directional, tri-directional, quad-directional, etc.).

In FIGS. 8-12, the elastic member 254 includes a first portion 254*a* (e.g., end portion or edge portion) attached to the upper 214, to the sole 212, or to any combination thereof. For example, the first portion 254*a* may be securely captured between the upper 214 and the sole 212 near the biteline. Although not shown in the figures, the other side of the footwear article 210 that is obscured from view in FIGS. 8-12 may include another portion of the elastic member 254 coupled to the upper, to the sole, or to any combination thereof. In addition, the elastic member 254 includes an elongate portion 254*b* (e.g., foremost, leading edge) that extends both superiorly and posteriorly from the first portion to a pull portion 254*c*. In FIG. 8, the pull portion 254*c* is in a first position that is superior to the hinge 252, and the pull portion 254*c* is movable, such as by pulling downward and rearwardly on the pull loop 290, to a second position (e.g., FIG. 12) that is inferior to the hinge 252. In a further aspect, the elastic member 252 includes a tacked-down portion 254*d* (e.g., portion of elastic member captured between the fixed-state connector 256 and the heel flap 250) that is attached by a fixed-state connector 256 to the heel flap 250. For example, in FIG. 8 the fixed-state connector 256 is a stitch line, and other fixed-state connectors may include bonding, welding, heat staking, riveting, etc. In an aspect of this disclosure, the tacked-down portion 254*d* is closer to the edge segment of the heel flap 250 coupled to the hinge 252 (e.g., reference number 151 in FIGS. 4 and 5 or edge 251 in FIG. 12) than the pull portion 254*c*. As such, when a force is applied to the pull portion 254*c*, the force is transferred to the tacked-down portion 254*d*, and may rotate the heel flap 250 on the hinge 252.

The hinge 252 might be attached at various locations along the collar 236. For example, in FIGS. 8-12, the hinge 252 is attached to the collar 236 along a segment of the collar that intersects a vertical, longitudinal reference plane of the footwear article (e.g., plane 29 of FIG. 2). However, in other aspects of the present disclosure, the hinge and the heel flap may be offset to the medial side or to the lateral side. For example, in some instances, the hinge and the heel flap may be offset to create a larger foot-insertion opening along a foot-entry path that is not a straight on with the longitudinal direction of the footwear article. The position of the hinge and the heel flap may be based on various factors, such as selecting a foot-insertion opening configured to fit a prosthetic or brace or other equipment (e.g., ankle guard, shin guard, etc.).

Figure 12:
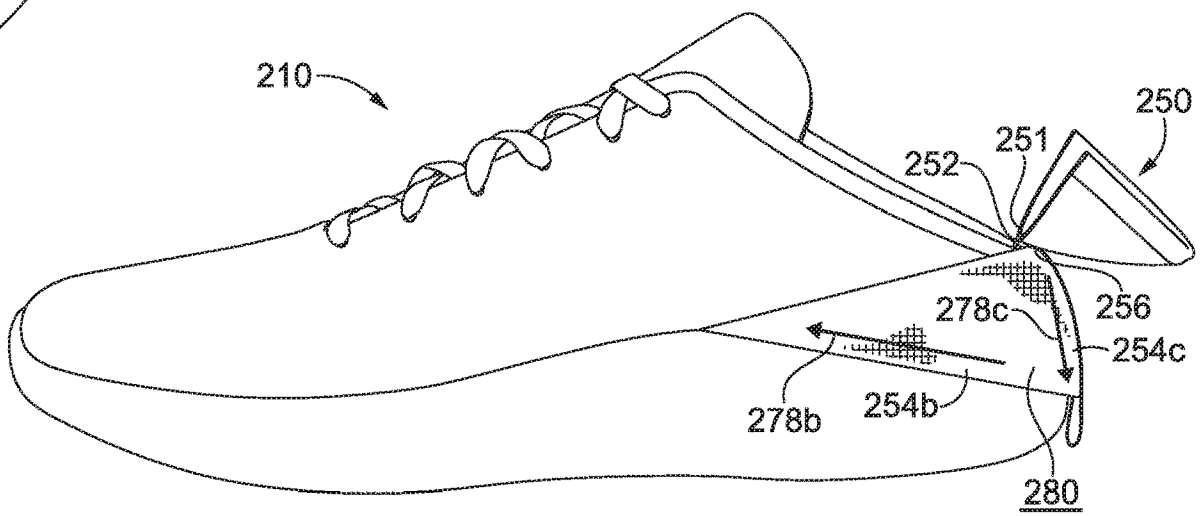
FIG. 12 includes an elevation view of the lateral side of the third footwear article with the elastic panel or band pulled downward and engaged with a sole of the third footwear article in accordance with an aspect of the present disclosure.

The footwear article 210 may include other features as well. As depicted in FIG. 8, the footwear article 210 includes the heel flap 250 in a first position, which is more upright, biased by the elastic member 254 compressing the heel flap 250 towards the foot-receiving cavity 216. For example, the elastic member 254 may apply a compressive force along the elongate portion 254*b* with a force vector 278*a* pointing towards the first portion 254*a*. In the first position, the heel flap 250 at least partially obscures the foot-insertion opening 218 (as compared with other positions of the heel flap), which may reduce a size of the foot-insertion opening 218 and may limit angles from which a foot may be inserted or removed from the foot-receiving cavity 216. The first position in FIGS. 8 and 9 may also be referred to as a closed position or state. In addition, as depicted in FIG. 12, the footwear article 210 includes the heel flap 250 in a second position, which is more downward or rearward, as the heel flap 250 has been rotated rearwardly on the hinge 252 away from the foot-receiving cavity 216, in a clockwise direction (based on the view in FIGS. 8 and 9). In the second position, the heel flap 250 is biased downward and rearward by the elastic member 254 pulling on the heel flap 250. That is, as depicted in FIG. 12, the elastic member 254, which is frictionally engaged on the sole 212, applies a force (e.g., tensional force) to the heel flap 250 at the connection 256 in the direction of the force vector 278*c*.

In one aspect of the disclosure, heel flap 250 may rotate by 90 degrees or more as the heel flap 250 transitions from the first position to the second position. The amount of rotation may be measured using various techniques, such as the same technique described with respect to the footwear article 110.

Figure 10:
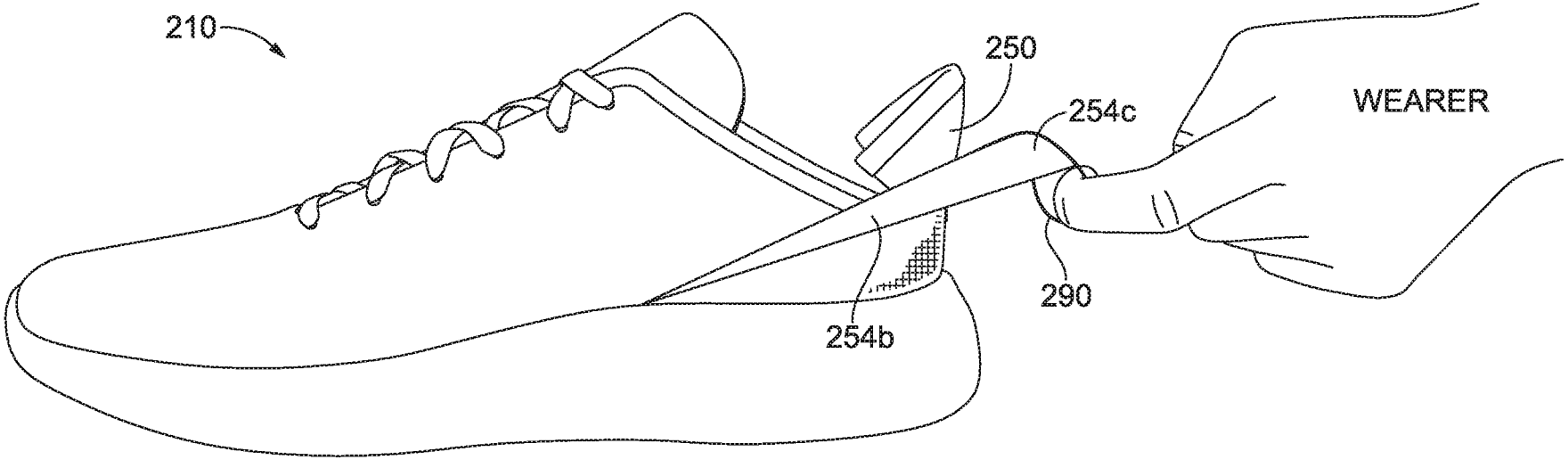
FIG. 10 includes an elevation view of the lateral side of the third footwear article with the elastic panel or band being pulled rearward and/or downward in accordance with an aspect of the present disclosure.
Figure 11:
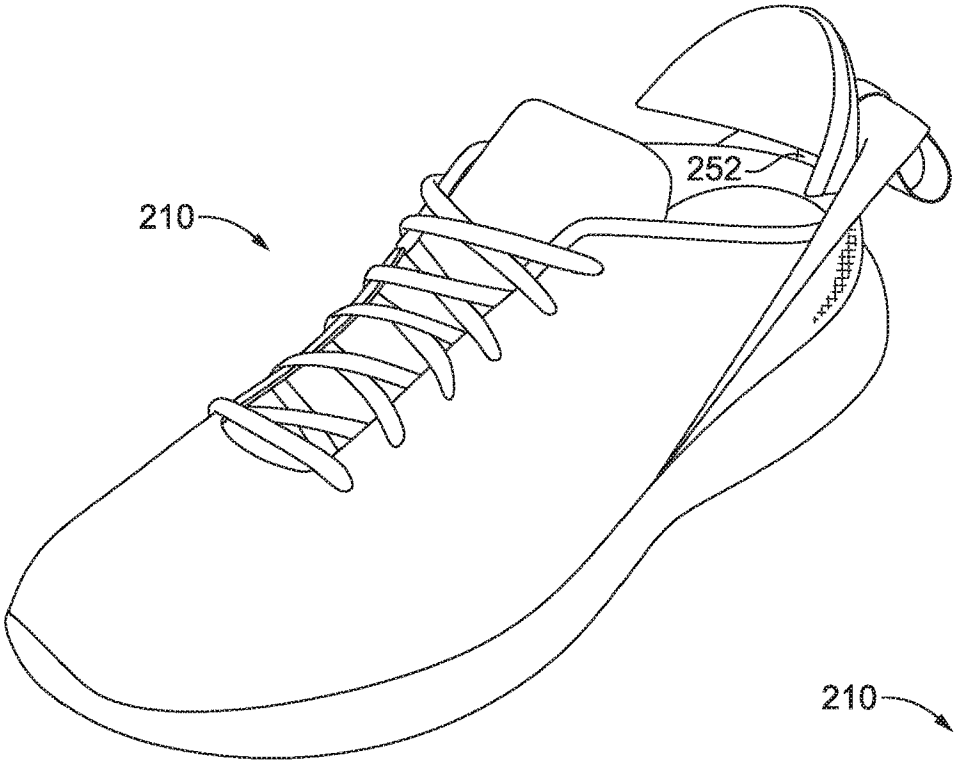
FIG. 11 includes a perspective view of the third footwear article with the elastic panel or band pulled partially downward in accordance with an aspect of the present disclosure.

The elastic member 254 may bias or help to retain the heel flap 250 in various positions. For example, when the elastic member 254 is arranged in a first position depicted in FIG. 8 (e.g., pull portion 254*c* superior to the hinge 252), with the heel flap 250 in position to support a heel or Achilles of a wearer, the elastic member 254 applies a compressive force on the heel flap 250 in the direction of the force vector 278*a*. This arrangement may be created by various contributing elements, including the position of the hinge 252, the position of the fixed-state connector 256, the connection of the portion 254*a* forwardly of the hinge 252 along the biteline, or any combination thereof. In a further aspect, the positions of the elastic member 254 and the heel flap 250 may be manually manipulated. For example, as depicted in FIG. 10, a wearer may pull and stretch downwardly on the pull portion 254*c* (e.g., using the pull loop 290). The pull portion 254*c* may be pulled down and secured against the sole 212 (e.g., the midsole side wall), such that the pull portion 254*c* is inferior to the hinge 252. For example, FIG. 12 depicts the pull portion 254*c* biased onto the heel portion of the sole 212. When arranged in the position depicted in FIG. 12, the elastic member 254 may apply various forces to different parts of the footwear article 210. For example, a compressive force in the direction of force vector 278*b* may be applied against the sole 212, in the direction of the connection at the portion 254*a*. In addition, a tension force may be applied to the connection 256 in the direction of the force vector 278*c*. The tension force may operate to rotate the heel flap 250 rearwardly and bias the heel flap 250 in a more open position, and the compressive force may operate to hold the elastic member 254 against the sole 212 to bias the heel flap 250 in position and reduce the likelihood of inadvertent closure. Once a wearer has inserted his or her foot through the foot-insertion opening and into the foot-receiving cavity, the pull loop 290 may be pulled upward to secure the footwear article 210 onto the foot.

The footwear article 210 may include other elements as well. In one aspect, a lever is formed by the hinge 252, the heel flap 250, and the pull portion 254*c*. For example, when the heel flap 250 is in the first position represented in FIG. 8 and is rotated rearwardly, the system may include a lever (e.g., class 3 lever), in which the hinge 252 is a fulcrum, the heel flap 250 is the load, and a force applied to the pull portion 254*c* and transferred to the heel flap 250 by way of the connection 256 is the effort that moves the heel flap 250. For example, the force may be applied to the pull portion 254*c* when the pull portion 254*c* is moved from a first position that is superior to the hinge 252 to a second position inferior to the hinge 252. In another aspect of the disclosure, the elastic member includes a first surface 280 and a second surface 270. When the pull portion 254*c* is in the first position superior to the hinge 252, then the first surface 280 faces towards, and compresses against, the heel flap 250 and the second surface 270 faces away from the heel flap 250. Further, when the pull portion 254*c* is in the second position inferior to the hinge 252, the second surface 270 faces towards, and compresses against, the sole 212 and the first surface 280 faces away from the sole.

In the aspect illustrated in FIGS. 8-12, the elastic member 254 substantially envelops the heel portion of the footwear article 210, since the elastic member 254 extends a full distance between the top edge of the elastic member 254 down to the connection near the biteline transition 213. In other aspects, the elastic member 254 may have different sizes and may cover or envelop a lesser amount of the heel portion of the footwear article 210, while still functioning in a manner similar to the illustrated elastic member 254 to bias or secure the heel flap 250 in a position. For example, the elastic member 254 may include a height extending from a lower edge positioned between the connection 256 and the biteline transition 213 to the top edge of the elastic member, such that a portion of the heel region of the upper (e.g., above the biteline transition 213) is exposed and not enveloped by the elastic member.

The elasticity of the elastic member 254 may include various properties. For example, in one aspect, the elastic member 254 elastically deforms (e.g., elongatedly stretches) when the heel flap 250 is manipulated rearwardly (e.g., with a hand or foot of a wearer), such that the elastic member 254 is able to return to a previous condition after the force is removed. In another aspect, the elastic member 254 is able to stretch a distance under a rearwardly directed force to allow the heel flap 250 to rotate rearwardly on the hinge 252. In at least one aspect, the distance to which the elastic member 254 elastically stretches is at least such that the point at which the elastic member attaches to the upper (e.g., 253), the hinge 252, and the fixed-state connector 256 are substantially coplanar (see e.g., reference line 284 in FIG. 9 illustrating an approximate location of a reference plane in which these portions would be coplanar when the elastic member 254 is elastically stretched rearward). In another aspect, the elastic member 254 may apply a force sufficient to rotate the heel flap 250 when the heel flap is at different positions. For example, in a closed state represented in FIG. 8, the elastic member 254 may actively pull or compress the heel flap 250 towards the foot-receiving cavity. Alternatively, in the closed state, the elastic member 254 may be taut, but not actively tensed or elastically stretched.

Some aspects of this disclosure have been described with respect to the examples provided in the figures. Additional aspects of the disclosure will now be described that may be related subject matter included in one or more claims or clauses of this application at the time of filing, or one or more related applications, but the claims or clauses are not limited to only the subject matter described in the below portions of this description. These additional aspects may include features illustrated by the figures, features not illustrated by the figures, and any combination thereof. When describing these additional aspects, reference may be made to elements depicted by the figures for illustrative purposes.

As used herein and in connection with the claims listed hereinafter, the terminology "any of clauses" or similar variations of said terminology is intended to be interpreted such that features of claims/clauses may be combined in any combination. For example, an exemplary clause 4 may indicate the method/apparatus of any of clauses 1 through 3, which is intended to be interpreted such that features of clause 1 and clause 4 may be combined, elements of clause 2 and clause 4 may be combined, elements of clause 3 and 4 may be combined, elements of clauses 1, 2, and 4 may be combined, elements of clauses 2, 3, and 4 may be combined, elements of clauses 1, 2, 3, and 4 may be combined, and/or other variations. Further, the terminology "any of clauses" or similar variations of said terminology is intended to include "any one of clauses" or other variations of such terminology, as indicated by some of the examples provided above.

The following clauses are aspects contemplated herein.

Clause 1. A footwear article comprising: a sole; an upper coupled to the sole and including a collar; a heel flap connected to the collar by a hinge; an elastic elongate member having a first portion coupled to the sole, the upper, or any combination thereof, and a second portion coupled to the heel flap; and a fixed-state connector connecting the second portion of the elastic member to the heel flap.

Clause 2. The footwear article of clause 1, wherein the heel flap rotates on the hinge between a more forwardly rotated closed state and a more rearwardly rotated open state.

Clause 3. The footwear article of clause 1 or 2, wherein the fixed-state connector comprises a portion of the heel flap free to retrogradely orbit the elastic member as the heel flap transitions between a closed state and an open state.

Clause 4. The footwear article of any of clauses 1-3, wherein the fixed-state connector comprises an encasement sleeve having a channel through which the elastic member extends, the channel being at least partially bounded by an interior surface of the encasement sleeve facing towards the elastic member, wherein the interior surface is free to retrogradely orbit around the elastic member when the heel flap rotates on the hinge.

Clause 5. The footwear article of any of clauses 1 through 4, wherein: in a closed position, the elastic member applies a first force to the heel flap, the first force including a first force vector pointing towards the first portion of the elastic member; and in an open position, the elastic member applies a second force to the heel flap, the second force including a second force vector pointing towards the first portion of the elastic member.

Clause 6. The footwear article of any of clauses 1 through 5, wherein in a closed position, the heel flap includes an interior surface facing towards a foot-receiving cavity of the footwear article, the interior surface being concave in the closed position; and wherein in an open position, the interior surface faces away from the footwear article and is convex.

Clause 7. The footwear article of clause 1, wherein the elastic member includes an elongate portion extending both superiorly and posteriorly from the first portion to a pull portion of the elastic member, the pull portion being movable between a first position that is superior to the hinge and a second position that is inferior to the hinge; and wherein the second portion of the elastic member coupled to the heel flap is between the pull portion and the hinge along a reference line tracing the elastic member.

Clause 8. The footwear article of clause 7, wherein the fixed-state connector extends at least partially through a thickness of the elastic member and at least partially through a thickness of the heel flap.

Clause 9. A footwear article comprising: a sole; an upper coupled to the sole and including a collar; a heel flap connected to the collar by a hinge; an elastic elongate member having a first portion coupled to the sole, the upper, or any combination thereof, and a second portion connected to the heel flap by a fixed-state connector comprising a connected state without repeated convertibility back and forth between the connected state and a disconnected state; and the fixed-state connector comprising an encasement sleeve coupling the second portion of the elastic member to the heel flap, the encasement sleeve having a channel through which the elastic member extends, the channel being at least partially bounded by an interior surface of the encasement sleeve facing towards the elastic member, wherein the interior surface is free to retrogradely orbit around the elastic member when the heel flap rotates on the hinge.

Clause 10. The footwear article of clause 9, wherein the heel flap includes one or more material layers, and wherein the channel is between an interior material layer formed by the one or more material layers and an exterior layer formed by the one or more material layers.

Clause 11. The footwear article of clauses 9 or 10, wherein the encasement sleeve is secured in a collar portion of the heel flap.

Clause 12. The footwear article of any of clauses 9 through 11, wherein the heel flap rotates on the hinge between a more forwardly rotated closed state and a more rearwardly rotated open state; and wherein in the open position, the heel flap is rotated rearwardly on the hinge by more than 90 degrees as compared with the closed position.

Clause 13. The footwear article of any of clauses 9 through 12, wherein in an open state the heel flap is rotated rearwardly on the hinge by more than 135 degrees as compared with a closed position.

Clause 14. The footwear article of any of clauses 9 through 13, wherein the elastic member applies a compressive force on the heel flap in both the open state and the closed state.

Clause 15. The footwear article of any of clauses 9 through 14, wherein the elastic member includes a third portion coupled to the sole, the upper, or any combination thereof; wherein the second portion is a center segment of the elastic member between the first portion and the second portion; and wherein the first portion is coupled to a medial side of the footwear article and the third portion is coupled to a lateral side of the footwear article.

Clause 16. A footwear article comprising: a sole; an upper coupled to the sole and including a collar; a heel flap connected to the collar by a hinge; and an elastic member comprising: an end portion coupled to the sole, the upper, or any combination thereof; an elongate portion extending both superiorly and posteriorly from the end portion to a pull portion of the elastic member, the pull portion being movable between a first position that is superior to the hinge and a second portion that is inferior to the hinge; and a tacked-down portion coupled to the heel flap by a fixed-state connector comprising a connected state without repeated convertibility back and forth between the connected state and a disconnected state.

Clause 17. The footwear article of clause 16, wherein an edge segment of the heel flap is coupled to the hinge; wherein the tacked-down portion is closer to the edge segment than the pull portion; wherein the hinge is a fulcrum of a lever and the heel flap is a load of the lever; and wherein a first force applied to the pull portion to move the pull portion from the first position to the second position is transferred to the fixed-state connector to bias the load rearward.

Clause 18. The footwear article of clause 16 or 17, wherein, when the pull portion is in the first position, the elastic member includes a first surface that faces towards and compresses against the heel flap and a second surface that faces away from the heel flap; and wherein, when the pull portion is moved to the second position, the second surface faces towards and compresses against the sole and the first surface faces away from the sole.

Clause 19. The footwear article of clause 18, wherein, when the pull portion is moved to the second position and the second surface compresses against the sole, a first force vector of a compressive force applied by the second surface to the sole points towards the end portion, and a second force vector of a tensile force applied by the tacked-down portion to the fixed-state connector and the heel flap points towards the pull portion.

Clause 20. The footwear article of clause 16, wherein the fixed-state connector coupling the tacked-down portion of the elastic member to the heel flap is a stitch, a bond, a weld, a heat stake, a rivet, or any combination thereof.

Clause 21. The footwear article of any of clauses 1-20, wherein the fixed-state connector comprises a connected state without repeated convertibility back and forth between the connected state and a disconnected state.

From the foregoing, it will be seen that this subject matter is well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the subject matter without departing from the scope of this disclosure, it is to be understood that all matter herein set forth or shown in the accompanying drawings is to be interpreted as illustrative and not in a limiting sense.

The invention claimed is:

1. A footwear article comprising:

a sole;

an upper coupled to the sole and including a collar;

a heel flap connected to the collar by a hinge;

an elastic member having a first portion coupled to the sole, the upper, or any combination thereof, and a second portion coupled to the heel flap; and a fixed-state connector connecting the second portion of the elastic member to the heel flap, wherein the heel flap rotates on the hinge between a more forwardly rotated closed state and a more rearwardly rotated open state;

wherein in the closed position, the heel flap includes an interior surface facing towards a foot-receiving cavity of the footwear article, the interior surface being concave in the closed position; and wherein in the open position, the interior surface faces away from the footwear article and is convex;

wherein in the closed state, the elastic member applies a first force to the heel flap, the first force including a first force vector pointing towards the first portion of the elastic member; and wherein in the open state, the elastic member applies a second force to the heel flap, the second force including a second force vector pointing towards the first portion of the elastic member.

2. The footwear article of claim 1, wherein the fixed-state connector comprises a connected state without repeated convertibility back and forth between the connected state and a disconnected state.

3. The footwear article of claim 2, wherein the fixed-state connector comprises a portion of the heel flap free to retrogradely orbit the elastic member as the heel flap transitions between the closed state and the open state.

4. The footwear article of claim 3, wherein the fixed-state connector comprises an encasement sleeve having a channel through which the elastic member extends, the channel being at least partially bounded by an interior surface of the encasement sleeve facing towards the elastic member, wherein the interior surface is free to retrogradely orbit around the elastic member when the heel flap rotates on the hinge.

5. The footwear article of claim 1, wherein the elastic member includes an elongate portion extending both superiorly and posteriorly from the first portion to a pull portion of the elastic member, the pull portion being movable between a first position that is superior to the hinge and a second position that is inferior to the hinge; and wherein the second portion of the elastic member coupled to the heel flap is between the pull portion and the hinge along a reference line tracing the elastic member.

6. The footwear article of claim 5, wherein the fixed-state connector extends at least partially through a thickness of the elastic member and at least partially through a thickness of the heel flap.

7. A footwear article comprising:

a sole;

an upper coupled to the sole and including a collar;

a heel flap connected to the collar by a hinge, the heel flap having a collar portion;

an elastic member having a first portion coupled to the sole, the upper, or any combination thereof, and a second portion connected to the heel flap by a fixed-state connector comprising a connected state without repeated convertibility back and forth between the connected state and a disconnected state; and the fixed-state connector comprising an encasement sleeve secured in the collar portion of the heel flap, the encasement sleeve coupling the second portion of the elastic member to the heel flap, the encasement sleeve having a channel through which the elastic member extends, the channel being at least partially bounded by an interior surface of the encasement sleeve facing towards the elastic member, wherein the interior surface is free to retrogradely orbit around the elastic member when the heel flap rotates on the hinge.

8. The footwear article of claim 7, wherein the heel flap includes one or more material layers, and wherein the channel is between an interior material layer formed by the one or more material layers and an exterior layer formed by the one or more material layers.

9. The footwear article of claim 7, wherein the heel flap rotates on the hinge between a more forwardly rotated closed state and a more rearwardly rotated open state; and wherein in the open position, the heel flap is rotated rearwardly on the hinge by more than 90 degrees as compared with the closed position.

10. The footwear article of claim 9, wherein in the open state the heel flap is rotated rearwardly on the hinge by more than 135 degrees as compared with the closed position.

11. The footwear article of claim 9, wherein the elastic member applies a compressive force on the heel flap in both the open state and the closed state.

12. The footwear article of claim 7, wherein the elastic member includes a third portion coupled to the sole, the upper, or any combination thereof; wherein the second portion is a center segment of the elastic member between the first portion and the second portion; and wherein the first portion is coupled to a medial side of the footwear article and the third portion is coupled to a lateral side of the footwear article.

* * * * *